222-107 SR
10/22/85 OR 4,548,338

United States Patent [19]
Sander

[11] Patent Number: 4,548,338
[45] Date of Patent: Oct. 22, 1985

[54] PACKING TUBE

[75] Inventor: Engelbert Sander, Vouvry, Switzerland

[73] Assignee: Automation Industrielle, S.A., Vouvry, Switzerland

[21] Appl. No.: 545,536

[22] Filed: Oct. 26, 1983

[30] Foreign Application Priority Data

Oct. 29, 1982 [DE] Fed. Rep. of Germany ..... 3240225

[51] Int. Cl.[4] ..... B65D 35/10
[52] U.S. Cl. ..... 222/107; 222/92; 220/450; 220/465
[58] Field of Search ..... 222/107, 92; 220/465, 220/450, 1 S, 67; 156/293

[56] References Cited

U.S. PATENT DOCUMENTS

| | | | |
|---|---|---|---|
| 3,565,293 | 2/1971 | Schultz | 222/107 |
| 4,011,968 | 3/1977 | McGhie et al. | 222/107 |
| 4,132,331 | 1/1979 | Mägerle | 222/107 |

FOREIGN PATENT DOCUMENTS

| | | | |
|---|---|---|---|
| 0295349 | 1/1968 | Australia | 222/107 |

*Primary Examiner*—Joseph J. Rolla
*Assistant Examiner*—Nils E. Pedersen
*Attorney, Agent, or Firm*—Collard, Roe & Galgano

[57] ABSTRACT

There is provided a packing tube having a gas tight head region. The tube consists of a tube body formed of a multilayered connecting foil having a metallic barrier layer. A prefabricated conical headpiece is provided consisting of synthetic material having a discharge opening and a connecting element disposed thereon. The connecting element consists of a connecting foil including a metallic layer and at least one layer of synthetic material. The peripheral rim of the tubular body overlaps the outer rim of the connecting element either thereabove or therebelow, and wherein the superimposed layers of synthetic material are softened by inductive generation of heat in the metal layers, and welded to one another under pressure. The headpiece consists of two overlapping portions, the lower portion completely covering the underside of the upper portion, the lower portion consisting of a non-permeable material. The outer diameter of the headpiece is smaller than the inner diameter of the tubular body. The outer rim edge formed by the superimposed upper and lower portions of the headpiece is undercut, and forms a portion of the surface of a cone, whose apex lies on the central axis of the tube, and directed oppositely to the discharge opening of the headpiece. For locking the headpiece portions, synthetic material of the connecting foil is overlappingly formed on the undercut outer rim edge of the headpiece overlapping at least the connecting line of the upper and lower parts.

9 Claims, 4 Drawing Figures

PACKING TUBE

The invention relates to a packing tube, consisting of a tubular body, of a multi-layered connecting foil with a metallic barrier layer, of a conical prefabricated headpiece consisting of synthetic material and provided with a discharge opening, and of a connecting element disposed thereon. The connecting element consists of a metallic layer and of a connecting foil containing at least one layer of synthetic resin material, the peripheral rim of the tubular body overlaps the outer rim of the connecting element therebelow or thereabove, the superimposed synthetic resin material layers being softened by inductive generation of heat in the metal and welded under the application of pressure.

A packing tube of this type is known from DE-OS No. 26 28 014, particularly with respect to FIGS. 4 and 5 thereof. In this case a prefabricated headpiece of polyethylene is fabricated and welded to a tubular body by means of a connecting element through inductive heating of the metal layer by high frequency, which softens the adjoining layers of synthetic material. The peripheral rim of the tubular conduit is described as overlapping the connecting element. In the implementation according to FIGS. 1 and 2 of the patent document, the peripheral rim of the tubular body extends below the connecting element. The synthetic resin layers of the connecting element and of the tubular body consist of a material which can be welded very well to the tubular head consisting of polyethylene. This implementation of a packaging tube fulfills the requirements with respect to firmness, but with respect to absorption it is not quite adequate.

Due to the fact that in this tube the connecting element includes a barrier layer, parts of the tube shoulder are protected against diffusion particularly from the exterior, but the tube head made of polyethylene and disposed between the head barrier layer and the contents of the tube absorbs considerable amounts of volatile components, for example aromatic materials, which result in a disadvantageous change of the quality of the contents.

In the embodiment shown in FIG. 3 of the patent document, the connecting element in conjunction with the barrier layer forms the entire conical part of the headpiece, and its barrier layer forms a part of the discharge opening. A threaded head sleeve is applied only onto this part. Although an improvement of the gas sealability is obtained thereby, the manufacture of such headpieces is more complicated, for example, by the multiple deformation of the aluminum barrier layer in various directions and its connection with the threaded head sleeve. Furthermore, the stiffness of the head suffers, unless further expensive measures are undertaken which further complicate its manufacture.

A different method for increasing the gas sealability is presented by the teaching according to DE-AS No. 17 61 596. The tube described therein includes a tubular body of layered materials having an impermeable aluminum foil. To the upper end of the tubular body there is cast a headpiece of a relatively gas permeable easily deformable thermo-plastic material, such as polyethylene. A disc-like barrier element is disposed on the inner side of the headpiece. To reduce releaseability of the rim segment of the barrier element from the tubular body, the headpiece has a ring-shaped lip, which extends from the rim region inwardly and behind the rim segment of the disc-like barrier element. The barrier element includes projections engaging the headpiece. If the barrier element consists of a material, which cannot be welded under the usual conditions with the material of the headpiece, which is the case in the non-permeable synthetic material suitable for barrier elements, the connection is entirely dependent on the projections and/or the lip. A variant of this solution provides that also the threaded neck is integrated into the barrier element, and the thermoplastic headpiece has only a short neck segment which ends in a shortened ring-shaped segment forming the base of the neck segment. In this case the rim of the barrier element is disposed at a relatively large distance from the impermeable layer of the layered body, due to the casting of the headpiece, so that, although gas sealability occurs in the region of the neck, it does not occur on the rim portion, which has a considerably larger surface. Entry, for example of oxygen, as well as discharge of, for example aeromatic materials is possible through this rim region, as a result of which the tube contents are negatively changed. By casting of the thereby relatively thick headpieces to the tubular body the manufacture of the tube becomes complicated and expensive and the equipment unwieldy.

It is an object of the present invention to devise a tube as above described, which surrounds the tube contents in the head region with a substantially complete gas sealability, or optionally reduces the consumption of this impermeable synthetic material, which is very difficult to weld with the synthetic material of the foils. Also, it is an object that the individual parts of the tube may be easily connected to one another in a simple manner by way of a single operating process.

Because of a two part construction of the headpiece, the upper part of the headpiece can be completely covered by the lower gas-impermeable part so that gas sealability is insured. As the upper part is adapted to be easily welded to the layers of synthetic material forming the connecting body of the tube, a rigid connection of this part is also achieved. By means of an undercut, for example in the form of a partially conical embodiment of the outer rim edge, a firm locking engagement between the upper and lower parts of the headpiece is insured by supplying and attaching synthetic material to this edge. The headpieces may be used for various tubular diameters without any change. In the case of different diameters, it is only necessary to change the connecting element. Thus, the utilization of expensive impermeable synthetic material remains small, in spite of the enlargement of the tubular diameter. By constructing the tube such that the peripheral rim of the tubular body overlaps the outer rim of the connecting element from above or below while the edge of the peripheral rim of the tubular body abuts a step in the connecting element or a step in the headpiece, respectively, gas sealability is maintained between the headpiece and the tubular body.

By providing the lower part of the two piece headpiece with a cylindrically projecting neck which fits into a complementary recess in the neck of the upper part of the headpiece, only small locking forces are needed to hold the two parts together and it is also possible thereby to keep the packing tube neck gastight.

The lower part of the headpiece may consist of a non-permeable synthetic material or of a coated or non-coated metal depending on the utilization of the tube.

The present invention will be described and understood more readily when considered together with the accompanying drawings, in which.

Figure 3:
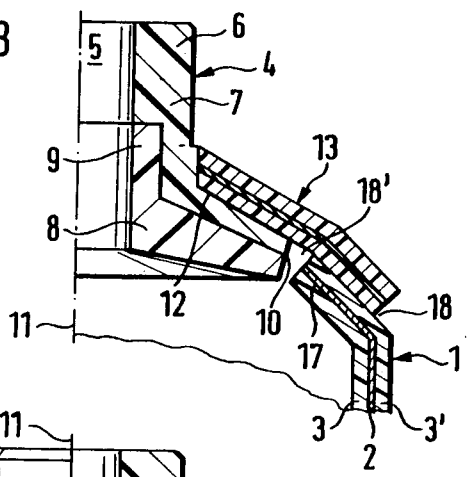
FIG. 3 is a view similar to that of FIG. 1 showing another embodiment of the packing tube of the present invention.

The tube according to the present invention includes a tubular body 1 in the form of a three-layered laminated foil. A center aluminum layer 2 is connected on each side with thermoplastic synthetic material layers 3 and 3' as outer layers, which can, for example, be formed of polyethylene or polypropylene. Both synthetic layers 3 and 3' can be formed of one material, or of respective different materials and different thicknesses, optionally also by using intermediate layers in dependence on the tube contents, the tube sizes or other parameters.

The tube further includes a prefabricated conical headpiece 4, which, on a converging end thereof, communicates with a neck 6 surrounding the discharge opening 5 of the tube. Neck 6 is provided with a non-illustrated outer thread for screwing on a non-illustrated closure cap. Headpiece 4 has an outer diameter $D_\alpha$ which is smaller than the inner diameter $D_i$ of tubular body 1. Headpiece 4 is formed in two pieces, an upper portion 7 having a neck 6, and a lower portion 8. Lower portion 8 completely covers the underside of upper portion 7. Lower portion 8 preferably includes a cylindrical projection 9 directed upwardly, which forms at least a part of the inner wall of the discharge opening 5. Upper portion 7 includes a recess corresponding to projection 9. Upper portion 7 is formed of a thermoplastic synthetic material, which can be relatively permeable, for example made of polyethylene. Preferably, upper portion 7 of headpiece 4 should be made of a synthetic material which can be easily welded to the material of which synthetic layers 3 and 3' are formed. Lower portion 8 of headpiece 4 should consist of a relatively non-permeable synthetic material, for example, a thermoplastic material having a greater non-permeability such as polypropylene, polyamine, polyester or a synthetic material hardened by heat, such as a urea formaldehyde, polyurethane or any other synthetic material or synthetic material mixture with comparable properties. Such materials, by comparison can be welded only with difficulty to the synthetic material of layers 3 or 3'.

The term non-permeable synthetic material includes arbitrary synthetic materials, which resist diffusion regarding their respective tube contents, and furthermore do not absorb any volatile components of the tube contents. As gas permeability is known for almost all synthetic materials, experimental tests including the contents of the tube are advantageous for selecting suitable synthetic materials.

By reducing the diameter of headpiece 4 in comparison to known tubes, utilization of expensive non-permeable synthetic material may be limited.

Lower portion 8 of headpiece 4 can also be made of metal, for example of aluminum in the form of a thin disc, with or without a coating of synthetic material or a coating of lacquer on one or both sides.

Headpiece 4 extends convergingly outwardly to and includes an outer rim edge 10 formed by both upper and lower portions 7 and 8, respectively. Headpiece 4 forms the surface of a cone or conical portion 12 whose apex lies on the central axis 11 of the tube and which extends away from discharge opening 5. The outer rim edge 10 of headpiece 4, because of the conical shape of the headpiece, is formed with an undercut wherein the edge of lower portion 8 is inward with respect to the edge of upper portion 7.

A ring-shaped conical connecting element 13 lies on conical shoulder portion 12 of headpiece 4, being tailored to its form, and abutting neck 6 of headpiece 4. Connecting element 13 is similar to, or identical with tubular body 1 with respect to its material and layer construction, and consequently also includes an aluminum layer 2 and synthetic resin layers 3 and 3'.

Figure 1:
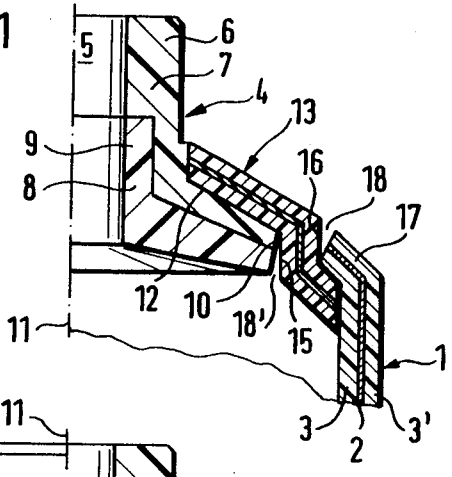
FIG. 1 is a cross sectional view of a segment of the head region of the packing tube, according to the present invention, wherein the individual parts are arranged prior to their non-releasable connection.
Figure 2:
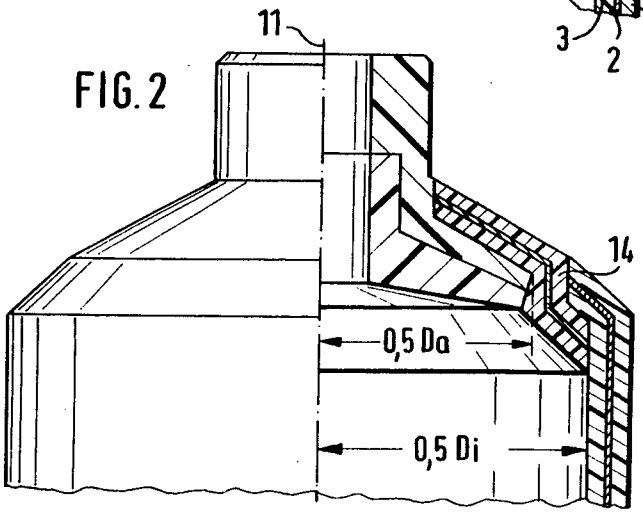
FIG. 2 shows a cross sectional segment on the right side of the packing tube of the present invention after welding of the individual parts and shows a plan view on the left side of the Figure.

According to the embodiment illustrated in FIGS. 1 and 2, connecting element 13 includes a step 14 near its outer rim. Step 14 has such a riser, that the reduced outer rim edge 10 of headpiece 4 is covered entirely, or at least partially, so that there is provided a side 15 of step 14 facing outer rim edge 10 of headpiece 4. An inwardly directed peripheral rim 17 of tubular body 1 is directed towards the other side 16 of step 14 with its cross-sectional side. The inwardly directed peripheral rim 17 of tubular body 1 abuts or lies on the outer rim of connecting element 13.

Figure 4:
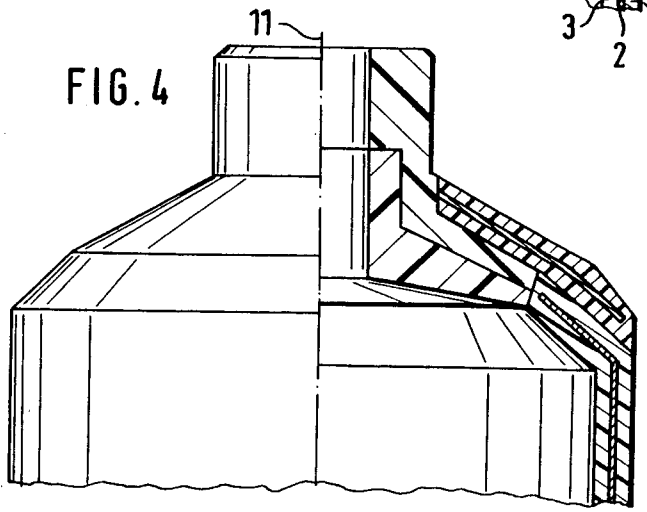
FIG. 4 shows a cross sectional segment on the right side of the packing tube of FIG. 3 after welding of the individual parts and shows a plan view on the left side of the Figure.

In the embodiment illustrated in FIGS. 3 and 4, the cross-sectional edge of the inwardly directed peripheral rim 17 is disposed in opposing relationship to the reduced outer edge of rim 10 of headpiece 4, and is overlapped by the outer rim of connecting element 13.

In manufacturing the tube, headpiece 4 is assembled from the upper and lower parts 7 and 8, then the connecting element 13 is set thereon and finally tubular body 1 is matched to the rim of connecting element 13 overlapping it, as in FIG. 1, or being disposed thereunder as in FIG. 3. Thereafter, the aluminum layer 2 in connecting body 13 and in the rim region of tubular body 1 is heated, for example, by high frequency induction. As a result of this heating the abutting synthetic material layers 3 and 3' are softened, and welded to form the tube. By exerting pressure thereonto, a strong connection of connecting body 13 with headpiece 4 and with tubular body 1 is insured, and wherein the softened synthetic material is distributed to such an extent, that the gaps 18 or 18' are filled (see FIGS. 2 and 4). By filling of gap 18 there is achieved a uniform surface, and by that of gap 18' the undercut region of headpiece 4 is filled out, as a result of which the firm and permanent locking of both parts 7 and 8 of the headpiece are insured. In the case of any substantial difference in thickness in the rim region of headpiece 4 of the tube, and the thickness of the tubular laminate used, such a flow of synthetic material results that the connecting location between the upper and lower portions 7 and 8 for the purpose of locking the two parts is overlapped and provides a quasi-mounting frame.

It is understood that the foregoing general and detailed descriptions are exemplary of the present invention and are not to be interpreted as restrictive of the scope of the following claims.

What is claimed is:

1. A packing tube, comprising:

(a) a tubular body formed of a multi layered foil including a metallic barrier layer disposed between layers of synthetic material and having an inwardly directed peripheral rim;

(b) a headpiece formed of synthetic material having a discharge opening, said headpiece including two superimposed portions, the lower portion completely covering the underside of the upper portion and formed of a non-permeable material, the outer diameter of said headpiece being less than the inner diameter of said tubular body, and said upper and lower portions forming an outer rim edge which is bevelled with respect to the central axis of the headpiece; and (c) a connecting element, disposed on said headpiece, including an upper and lower synthetic material layer and a metallic layer disposed therebetween, said connecting element having an outer rim which is positioned relative to the peripheral rim of said tubular body so that one overlaps the other, the superimposed layers of synthetic materials of said tubular body and said connecting element being welded to one another by inductive generation of heat in the metallic layers thereof and the exertion of pressure thereonto so that said synthetic material from at least one of said synthetic material layers of one of said connecting element and said tubular body is attached to the bevelled outer rim edge of said headpiece so as to overlie at least the interface of the upper and lower portions at said outer rim edge.

2. The packing tube as defined in claim 1, wherein the peripheral rim of said tubular body abuts the outer rim edge of said headpiece and is overlapped by the outer rim of said connecting element.

3. The packing tube as defined in claim 1, wherein said connecting element includes a step having a side which abuts the outer rim edge of said headpiece and the inwardly directed peripheral rim of said tubular body abuts the outer side of said step and overlaps the outer rim of said connecting element.

4. The packing tube as defined in claim 1, wherein the lower portion of said headpiece is provided with a cylindrical projection forming at least part of the inner wall of the discharge opening of said headpiece, and the upper portion of said headpiece is provided with an appropriate corresponding recess.

5. The packing tube as defined in claim 1, wherein the lower portion of said headpiece comprising a non-permeable synthetic material.

6. The packing tube as defined in claim 1, wherein the lower portion of said headpiece comprising a metallic material.

7. The packing tube as defined in claim 1, wherein the peripheral rim of said tubular body is overlapping the outer rim of said connecting element.

8. The packing tube as defined in claim 1, wherein the lower synthetic material layer of said connecting element is attached to the bevelled outer rim edge of said headpiece.

9. The packing tube as defined in claim 1, wherein at least one of the layers of synthetic material from said tubular body is attached to the bevelled outer rim edge of said headpiece.

* * * * *